US012325493B1

(12) United States Patent
Anderson et al.

(10) Patent No.: US 12,325,493 B1
(45) Date of Patent: Jun. 10, 2025

(54) WATERCRAFT WITH TOWER STORAGE

(71) Applicant: Arc Boat Company, San Francisco, CA (US)

(72) Inventors: Dylan Anderson, San Francisco, CA (US); Cristian Porter, San Francisco, CA (US); Michael Schier, San Francisco, CA (US)

(73) Assignee: Arc Boat Company, San Francisco, CA (US)

( * ) Notice: Subject to any disclaimer, the term of this patent is extended or adjusted under 35 U.S.C. 154(b) by 0 days.

(21) Appl. No.: 19/028,855

(22) Filed: Jan. 17, 2025

Related U.S. Application Data

(60) Provisional application No. 63/551,639, filed on Feb. 9, 2024.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC ..... B63B 17/02; B63B 2017/026
See application file for complete search history.

(56) References Cited

U.S. PATENT DOCUMENTS 5,697,320 A 12/1997 Murray
6,327,993 B1 12/2001 Richens, Jr.
6,863,016 B2 3/2005 Biemiller
6,994,050 B2 2/2006 Johnson et al.
7,063,037 B1 6/2006 Parks
7,270,075 B1 9/2007 Jones
2003/0089294 A1* 5/2003 Biemiller ..... B63B 25/002 114/343
2004/0187764 A1 9/2004 Eck et al.
2009/0229508 A1 9/2009 James
2010/0083891 A1 4/2010 Russikoff
2014/0103085 A1 4/2014 Patronik
2019/0345721 A1 11/2019 Mazzarelli et al.
2019/0359297 A1 11/2019 Lee
2020/0391827 A1 12/2020 Clarke

OTHER PUBLICATIONS

International Search Report & Written Opinion for PCT/US2025/012059, mailed Mar. 27, 2025, 13 pages.

* cited by examiner

*Primary Examiner* — Anthony D Wiest
(74) *Attorney, Agent, or Firm* — CASIMIR JONES, S.C.; Brian F. Bradley

(57) ABSTRACT

A watercraft comprising a hull and a tower assembly coupled to the hull. The tower assembly includes a cover with a front end, a rear end, a top side, and a bottom side. The tower assembly further includes a storage area with a plurality of straps coupled to the bottom side. The plurality of straps is spaced apart along a column axis that extends from the front end to the rear end. Each of the plurality of straps is elastically deformable.

17 Claims, 5 Drawing Sheets

WATERCRAFT WITH TOWER STORAGE

CROSS REFERENCE TO RELATED APPLICATIONS

This application claims priority to and the benefit of U.S. Provisional Patent Application No. 63/551,639, filed Feb. 9, 2024, which is incorporated herein by reference in its entirety for all purposes.

TECHNICAL FIELD

This disclosure relates to tower assemblies and roofs including storage for watercraft (e.g., boats).

BACKGROUND

Watercrafts typically include some form of on-board storage for storing various items (e.g., personal items, supplies, life preservers, fishing tackle, etc.). However, existing on-board storage solutions have numerous limitations. For example, boards utilized in watersports (e.g., water skis, kneeboards, wake boards, wake surf boards) are too large for existing storage solutions. Conventional designs large enough for boards include auxiliary racks coupled to either the tower or deck of a watercraft.

SUMMARY

The disclosure provides, in one aspect, a watercraft comprising a hull and a tower assembly coupled to the hull. The tower assembly includes a cover with a front end, a rear end, a top side, and a bottom side; and a plurality of straps coupled to the bottom side. The plurality of straps is spaced apart along a column axis that extends from the front end to the rear end. Each of the plurality of straps is elastically deformable.

In some embodiments, a cavity is at least partially formed by the plurality of straps and the bottom side.

In some embodiments, each of the plurality of straps is fixed at a first end to a side protrusion of the cover, and wherein each of the plurality of straps is fixed at a second end to an center protrusion of the cover.

In some embodiments, the plurality of straps is equally spaced apart along the column axis.

In some embodiments, the cover is rigid.

In some embodiments, the cover is made of a composite material.

In some embodiments, the tower assembly includes a first support and a second support, and the tower assembly is adjustable with respect to the hull.

In some embodiments, the tower assembly includes a tow point.

The disclosure provides, in one aspect, a watercraft roof comprising a rigid cover including a front end, a rear end, a top side, and a bottom side. The watercraft roof further includes a first strap coupled to the bottom side and extending along a first strap axis. The first strap coupled to the cover at a first end and coupled to the cover at a second end. The watercraft roof further includes a second strap coupled to the bottom side and extending along a second strap axis. The second strap axis spaced the first strap axis along a column axis extending from the front end to the rear end. The watercraft roof further includes a third strap coupled to the bottom side and extending along a third strap axis. The third strap axis spaced from the second strap axis along the column axis. The second strap is positioned between the first strap and the third strap. The first strap, the second strap, and the third strap are elastically deformable.

In some embodiments, the cover is made of a composite material.

In some embodiments, the first strap, the second strap, and the third strap are made of nylon, polyester, or a combination thereof.

In some embodiments, the cover includes a side protrusion and a center protrusion on the bottom side, wherein the first strap extends between the side protrusion and the center protrusion.

In some embodiments, the second strap extends between the side protrusion and the center protrusion; and wherein the third strap extends between the side protrusion and the center protrusion.

In some embodiments, the cover further includes a ridge on the bottom side extending between the side protrusion and the center protrusion.

In some embodiments, the first strap includes a first planar surface and a second planar surface, opposite the first planar surface.

In some embodiments, the watercraft roof further comprises a first bracket coupling the first end of the first strap to the cover and a second bracket coupling the second end of the first strap to the cover.

In some embodiments, the second strap axis is parallel to the first strap axis.

In some embodiments, the first strap, the second strap, and the third strap are part of a first plurality of straps; and wherein the watercraft roof further includes a second plurality of straps coupled to the cover.

In some embodiments, the second plurality of straps is spaced along a second column axis extending from the front end to the rear end.

In some embodiments, the second column axis is parallel to the column axis.

Other aspects of the disclosure will become apparent by consideration of the detailed description and accompanying drawings.

BRIEF DESCRIPTION OF THE DRAWINGS

These and other features, aspects, and advantages of the present technology will become better understood with regards to the following drawings. The accompanying figures and examples are provided by way of illustration and not by way of limitation.

Figure 1:
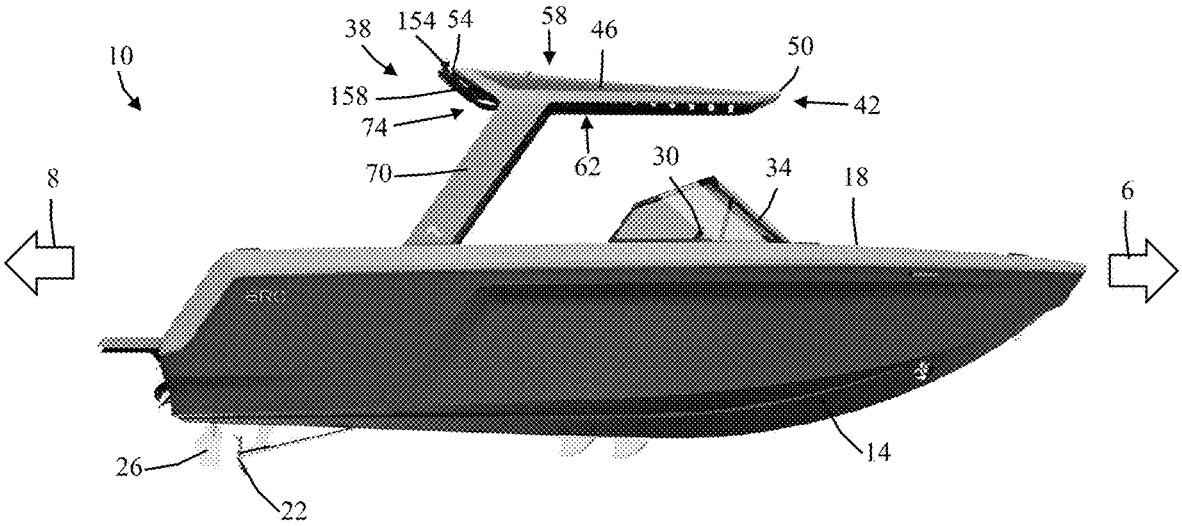
FIG. 1 is a side view of a watercraft with a tower assembly.

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

The term "coupled," as used herein, is defined as "connected," although not necessarily directly, and not necessarily mechanically. The term coupled is to be understood to mean physically, magnetically, chemically, fluidly, electrically, or otherwise coupled, connected or linked and does not exclude the presence of intermediate elements between the coupled elements absent specific contrary language.

To facilitate the understanding of this disclosure, a number of marine terms are defined below. Terms defined herein have meanings as commonly understood by a person of ordinary skill in the areas relevant to the present disclosure. "Starboard" refers to the right-hand, or driver's, side of the watercraft. "Port" refers to the left-hand, or passenger's, side of the watercraft. "Bow" refers to the front of the watercraft. "Transom" and "stern" refer to the rear of the watercraft. The bow 6 and stern 8 directions are illustrated in FIG. 1 for reference.

With reference to FIG. 1, a watercraft 10 includes a hull 14 that defines a top edge surface 18 commonly referred to as the gunwale or gunnel. In some embodiments, the watercraft 10 is propelled through the water by a propeller 22 that is rotationally driven by an electric drive. In some embodiments, the electric drive includes an electric motor (e.g., an induction motor, a synchronous motor, a brushless DC motor, a permanent magnet rotor, an interior permanent magnet motor, a surface permanent magnet motor, a reluctance motor, etc.) and a power converter (e.g., an inverter, a converter, etc.). In some embodiments, the watercraft 10 includes a battery electrically coupled to the electric drive. The watercraft 10 is steered through the water with adjustment of a rudder 26, for example, by an operator input 30 (e.g., steering wheel). In the illustrated embodiment, the watercraft 10 includes a windshield 34 coupled to the hull 14. In some embodiments, the windshield 34 includes a front portion that is bow-facing and side portions that are starboard-facing and port-facing.

Figure 2:
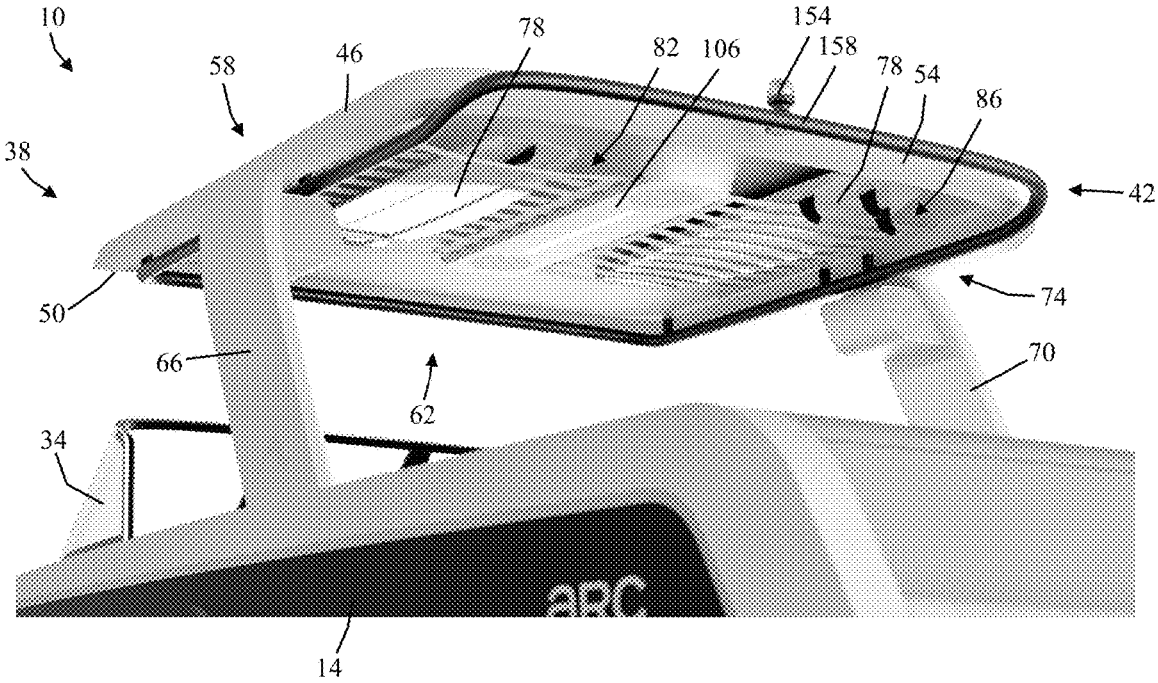
FIG. 2 is bottom perspective view of a tower assembly of a watercraft, illustrating a rigid cover and a plurality of straps in a storage area with wake boards stored therein.

With reference to FIGS. 1 and 2, the watercraft 10 includes a tower assembly 38 coupled to the hull 14. In some embodiments, the tower assembly 38 is adjustable relative to the hull 14 (e.g., the height of the tower assembly 38 is adjustable). The adjustable tower assembly 58 includes a roof 42 including a cover 46 having a front end 50, a rear end 54, a top side 58, and a bottom side 62. In the illustrated embodiment, the tower assembly 38 includes a first support 66 coupled to the cover 46, and a second support 70 coupled to the cover 46. In some embodiments, the cover 46 is rigid. In some embodiments, the cover 46 is made of a composite material. In some embodiments, the cover 46 is entirely made of a composite material. In some embodiments, the cover 46 is made of a fiberglass, a carbon fiber, or any suitable fiber-reinforced polymer.

With reference to FIG. 2, a storage area 74 is formed on the bottom side 62 of the cover 46 and is configured to, for example, receive and store one or more wake boards 78. As detailed further herein, the storage area 74 is a non-prescriptive storage area capable of holding boards, towels, life preservers, and other items.

Figure 3:
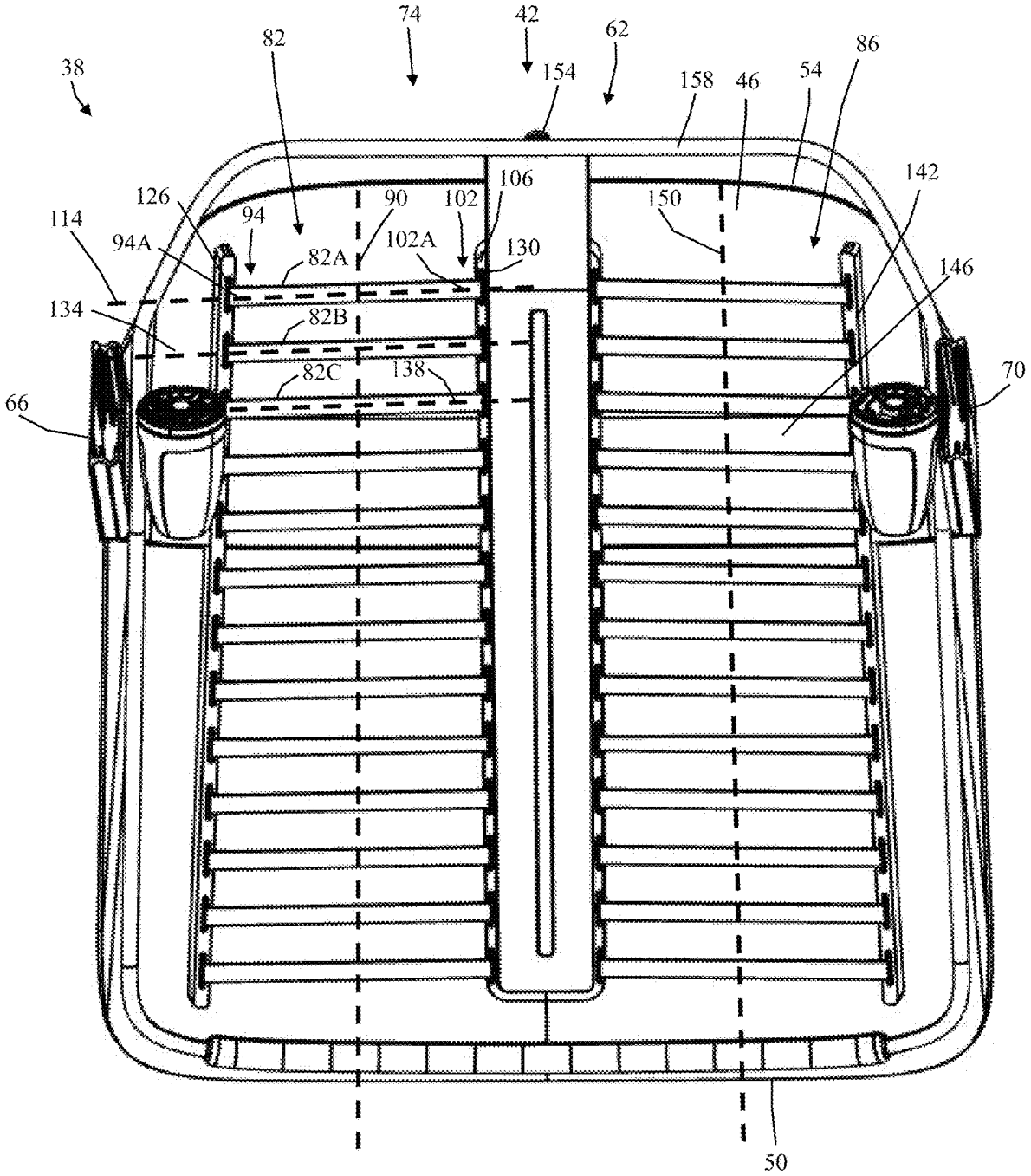
FIG. 3 is a bottom view of a watercraft roof including a rigid cover and a plurality of straps.

With reference to FIG. 3, the roof 42 of the tower assembly 38 further includes a plurality of straps 82, 86 coupled to the bottom side 62 of the cover 46. In the illustrated embodiment, the plurality of straps 82, 86 form at least a portion of the storage area 74. A first plurality of straps 82 is spaced apart along a first column axis 90 that extends from the front end 50 to the rear end 54 of the cover 46. In the illustrated embodiment, the first plurality of straps 82 is equally spaced apart along the column axis 90. Each of the first plurality of straps 82 is elastically deformable. Each of the first plurality of straps 82 is fixed at a first end 94 to a first side protrusion 98 of the cover 46, and each of the first plurality of straps 82 is fixed at a second end 102 to a center protrusion 106 of the cover 46. In the illustrated embodiment, each strap 82 extends between the first side protrusion 98 and the center protrusion 106. In the illustrated embodiment, a cavity 110 (FIG. 5) is at least partially formed by the first plurality of straps 82 and the bottom side 62 of the cover 46. In the illustrated embodiment, the cavity 110 forms at least a portion of the storage area 74.

Figure 6:
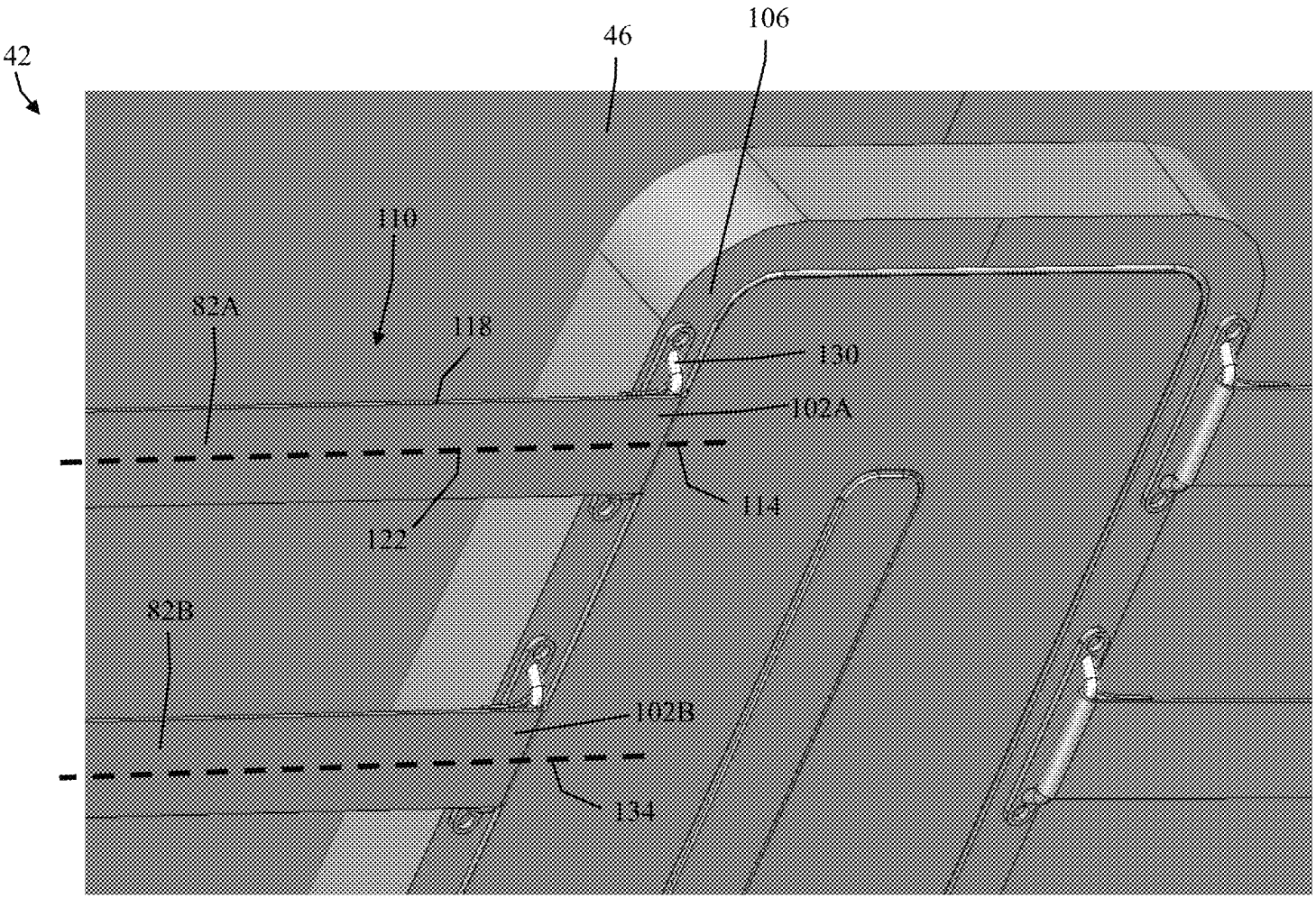
FIG. 6 is a partial bottom perspective view of the watercraft roof of FIG. 3.

With continued reference to FIG. 3, the first plurality of straps 82 includes a first strap 82A coupled to the bottom side 62 of the cover 46 and extending along a first strap axis 114. The first strap 82A is coupled to the cover 46 at a first end 94A and coupled to the cover 46 at a second end 102A. With reference to FIG. 6, the first strap 82A includes a first planar surface 118 and a second planar surface 122, opposite the first planar surface 118. In the illustrated embodiment, a first bracket 126 couples the first end 94A of the first strap 82A to the cover 46, and a second bracket 130 couples the second end 102A of the first strap 82A to the cover 46. In the illustrated embodiment, the ends of each strap are coupled to the cover with a bracket. In some embodiments, the bracket is formed as part of the cover.

Similarly, the first plurality of straps 82 includes a second strap 82B coupled to the bottom side 62 of the cover 46 and extending along a second strap axis 134. The second strap axis 134 is spaced from the first strap axis 114 along the column axis 90. In some embodiments, the second strap axis 134 is parallel to the first strap axis 114.

The first plurality of straps 82 further includes a third strap 82C coupled to the bottom side 62 of the cover 46 and extending along a third strap axis 138. The third strap axis 138 is spaced from the second strap axis 134 along the column axis 90. In the illustrated embodiment, the second strap 82B is positioned between the first strap 82A and the third strap 82C. In the illustrated embodiment, the first plurality of straps 82 form an array of straps. As disclosed herein, the first strap 82A, the second strap 82B, and the third strap 82C are each individually elastically deformable.

Figure 4:
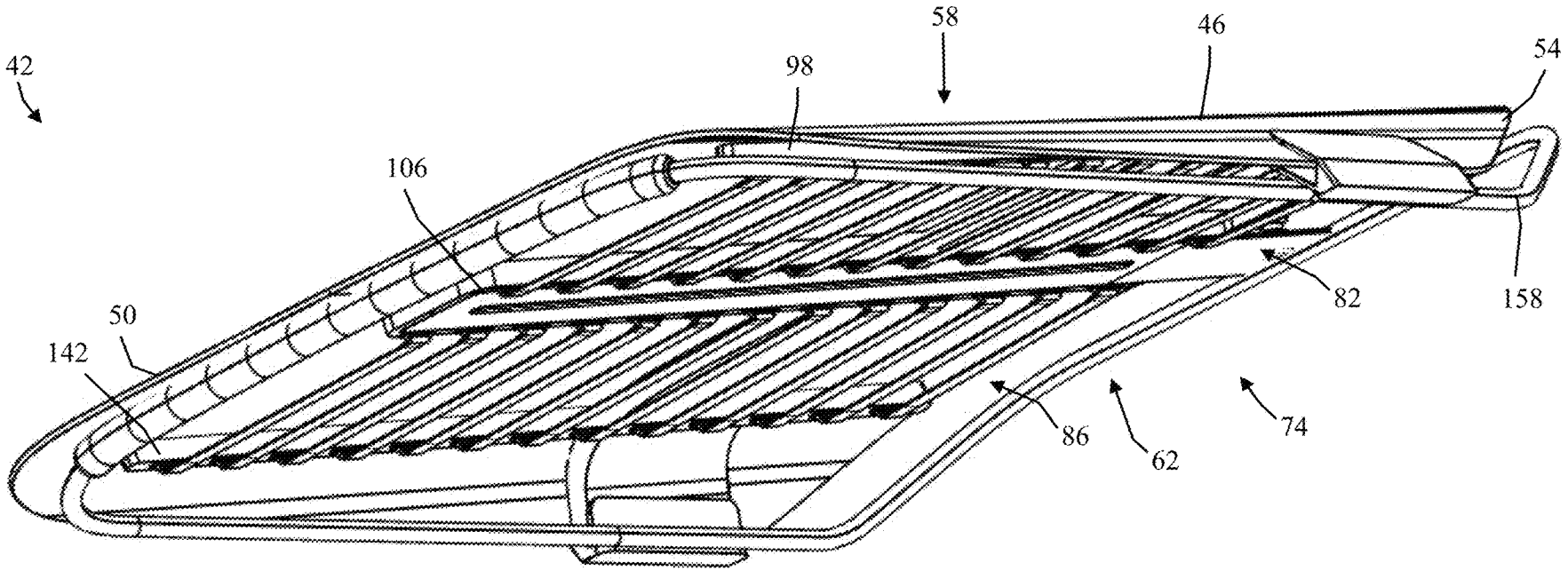
FIG. 4 is a perspective view of the watercraft roof of FIG. 3.
Figure 5:
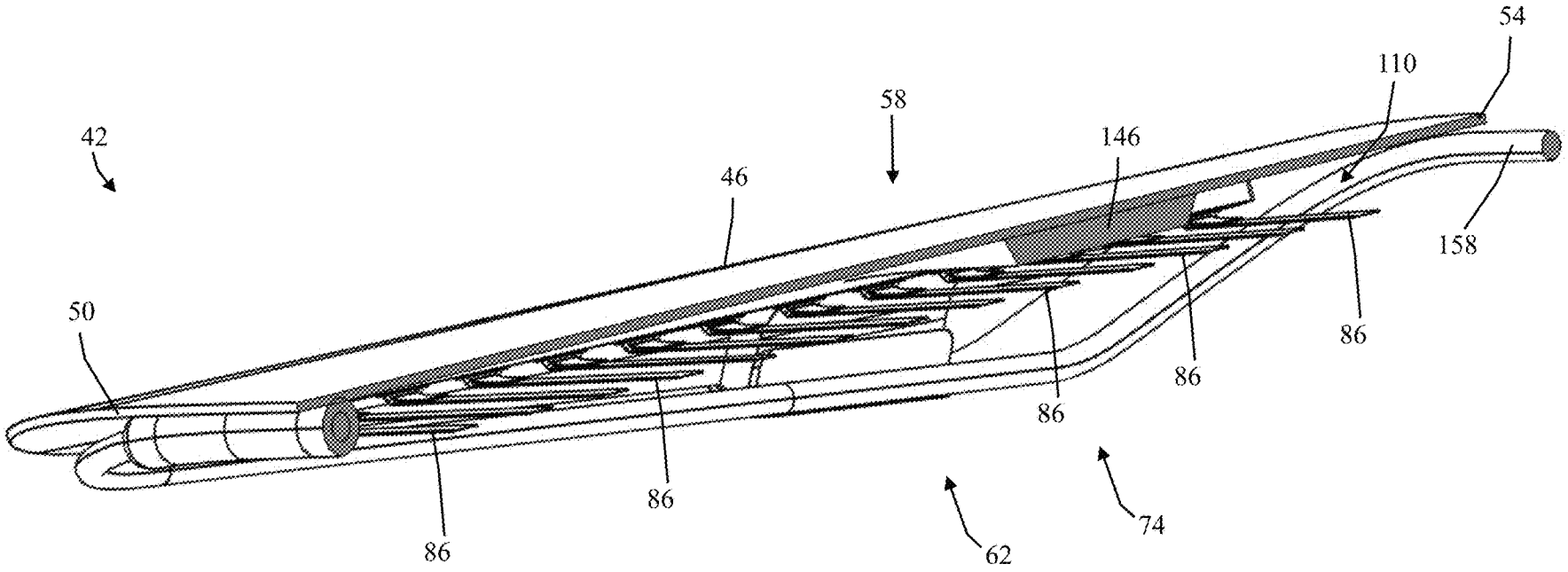
FIG. 5 is a perspective cross-sectional view of the watercraft roof of FIG. 3.

With reference to FIGS. 3 and 4, the cover 46 includes the first side protrusion 98, a second side protrusion 142, and the center protrusion 106 on the bottom side 62 of the cover 46. The first strap 82A extends between the first side protrusion 98 and the center protrusion 106. In the illustrated embodiment, the second strap 82B extends between the first side protrusion 98 and the center protrusion 106. In the illustrated embodiment, the third strap 82C extends between the first side protrusion 98 and the center protrusion 106. In some embodiments, each of the first plurality of straps 82 extends between the first side protrusion 98 and the center protrusion 106. With reference to FIG. 5, the cover 46 further includes a ridge 146 on the bottom side 62 that extends between the first side protrusion 98 and the center protrusion 106. In some embodiments, the ridge 146 extends between the second side protrusion 142 and the center protrusion 106. In the illustrated embodiment, the ridge 146 extends into the cavity 110.

With continued reference to FIG. 2, the roof 42 further includes a second plurality of straps 86 coupled to the cover 46. In some embodiments, the second plurality of straps 86 are similar or identical to the first plurality of straps 82 disclosed herein. In some embodiments the first plurality of straps 82 and the second plurality of straps 86 are made from nylon, polyester, or any combination thereof. In the illustrated embodiments, the straps 82, 86 are elastically deformable. In some embodiments, the straps 82, 86 are elasticized cords or members, commonly referred to as a "bungee." In the illustrated embodiment, the second plurality of straps 86 is spaced along a second column axis 150 extending from the front end 50 to the rear end 54 of the cover 46. In some embodiments, the second column axis 150 is parallel to the first column axis 90.

In the illustrated embodiment, the tower assembly 38 further includes a tow point 154 configured to receive a rope or tether for use in watersports, for example. IN the illustrated embodiment, the tower assembly 38 further includes a grab bar 158. In some embodiments, the center protrusion 106 of the cover 46 is coupled to the grab bar 158.

Advantageously, the first plurality of straps 82 is capable of receiving and securing a large object (e.g., a wake board, skis, life preservers, towels, etc.) to the bottom side 62 of the cover 46. Likewise, the second plurality of straps 86 is capable of independently receiving a securing another large object (e.g., a second wake board, etc.). In some embodiments, no tightening of straps is required to secure the objects in the storage area 74. In contrast, the object is weaved through the plurality of straps to secure the object to the roof 42. As such, a secured object may be positioned on one side of a first strap and on an opposite side of a second strap.

In the illustrated embodiment, the watercraft 10 is a boat. In other embodiments, the watercraft is a fishing boat, a dingy boat, a deck boat, a bowrider boat, a catamaran boat, a cuddy cabin boat, a center console boat, a houseboat, a trawler boat, a cruiser boat, a game boat, a yacht, a personal watercraft boat, a water scooter, a jet-ski, a runabout boat, a jet boat, a wakeboard, a ski boat, a life boat, a pontoon boat, or any suitable motor boat, vessel, craft, or ship. Although examples are illustrated with respect to an all-electric watercraft, the tower assembly with storage described herein can also be used in a conventional motorboat application (e.g., with a gasoline or diesel-powered engine).

Various features and advantages are set forth in the following claims.

What is claimed is:

1. A watercraft comprising:

a hull; and a tower assembly coupled to the hull; wherein the tower assembly includes:

a cover with a front end, a rear end, a top side, and a bottom side; and a plurality of straps coupled to the bottom side;

wherein the plurality of straps is spaced apart along a column axis that extends from the front end to the rear end;

wherein each of the plurality of straps is elastically deformable; and wherein each of the plurality of straps is fixed at a first end to a side protrusion of the cover, and wherein each of the plurality of straps is fixed at a second end to a center protrusion of the cover.

2. The watercraft of claim 1, wherein a cavity is at least partially formed by the plurality of straps and the bottom side.

3. The watercraft of claim 1, wherein the plurality of straps is equally spaced apart along the column axis.

4. The watercraft of claim 1, wherein the cover is rigid.

5. The watercraft of claim 1, wherein the cover is made of a composite material.

6. The watercraft of claim 1, wherein the tower assembly includes a first support and a second support, and the tower assembly is adjustable with respect to the hull.

7. The watercraft of claim 1, wherein the tower assembly includes a tow point.

8. A watercraft roof comprising:

a rigid cover including a front end, a rear end, a top side, and a bottom side;

a first strap coupled to the bottom side and extending along a first strap axis; the first strap coupled to the cover at a first end and coupled to the cover at a second end;

a second strap coupled to the bottom side and extending along a second strap axis, the second strap axis spaced the first strap axis along a column axis extending from the front end to the rear end; and a third strap coupled to the bottom side and extending along a third strap axis, the third strap axis spaced from the second strap axis along the column axis;

wherein the second strap is positioned between the first strap and the third strap; wherein the first strap, the second strap, and the third strap are elastically deformable;

wherein the cover includes a side protrusion and a center protrusion on the bottom side, wherein the first strap extends between the side protrusion and the center protrusion; and wherein the second strap extends between the side protrusion and the center protrusion; and wherein the third strap extends between the side protrusion and the center protrusion.

9. The watercraft roof of claim 8, wherein the cover is made of a composite material.

10. The watercraft roof of claim 8, wherein the first strap, the second strap, and the third strap are made of nylon, polyester, or a combination thereof.

11. The watercraft roof of claim 8, wherein the cover further includes a ridge on the bottom side extending between the side protrusion and the center protrusion.

12. The watercraft roof of claim 8, wherein the first strap includes a first planar surface and a second planar surface, opposite the first planar surface.

13. The watercraft roof of claim 8, further including a first bracket coupling the first end of the first strap to the cover and a second bracket coupling the second end of the first strap to the cover.

14. The watercraft roof of claim 8, wherein the second strap axis is parallel to the first strap axis.

15. The watercraft roof of claim 8, wherein the first strap, the second strap, and the third strap are part of a first plurality of straps; and wherein the watercraft roof further includes a second plurality of straps coupled to the cover.

16. The watercraft roof of claim 15, wherein the second plurality of straps is spaced along a second column axis extending from the front end to the rear end.

17. The watercraft roof of claim 16, wherein the second column axis is parallel to the column axis.

* * * * *